US006814270B2

(12) United States Patent
Mason

(10) Patent No.: US 6,814,270 B2
(45) Date of Patent: Nov. 9, 2004

(54) GUN HOLSTER

(76) Inventor: Richard A. Mason, 218 Rustic Ridge Dr., Kennesaw, GA (US) 30144

( * ) Notice: Subject to any disclaimer, the term of this patent is extended or adjusted under 35 U.S.C. 154(b) by 34 days.

(21) Appl. No.: 09/938,650

(22) Filed: Aug. 27, 2001

(65) Prior Publication Data

US 2003/0038151 A1 Feb. 27, 2003

(51) Int. Cl.[7] ..... A45C 1/04
(52) U.S. Cl. ..... 224/587; 224/627; 224/901.8
(58) Field of Search ..... 224/193, 587, 224/602, 603, 627, 647, 911, 901.4, 901.8; 36/136

(56) References Cited

U.S. PATENT DOCUMENTS

| | | | | | |
|---|---|---|---|---|---|
| 2,781,808 | A | | 2/1957 | Barnard | |
| 4,056,218 | A | | 11/1977 | Barna | |
| 4,260,089 | A | | 4/1981 | Daleo | |
| 4,346,827 | A | | 8/1982 | Bianchi et al. | |
| 4,674,664 | A | * | 6/1987 | Simon | 224/604 |
| 4,693,402 | A | | 9/1987 | Comeau | |
| 4,903,874 | A | * | 2/1990 | Shoemaker | 224/624 |
| 5,016,793 | A | | 5/1991 | Derkatz | |
| D325,301 | S | | 4/1992 | Winfrey | |
| 5,116,306 | A | * | 5/1992 | Zander | 602/19 |
| 5,120,288 | A | * | 6/1992 | Sinaki | 482/105 |
| 5,246,153 | A | * | 9/1993 | Beletsky | 224/192 |
| 5,251,799 | A | | 10/1993 | Theodore | |
| 5,345,633 | A | * | 9/1994 | Harnish | 5/639 |
| 5,400,935 | A | | 3/1995 | Farmer | |
| 5,431,318 | A | * | 7/1995 | Garcia | 224/192 |
| 5,544,745 | A | * | 8/1996 | Famorca | 206/320 |
| 5,806,742 | A | * | 9/1998 | Mott et al. | 224/645 |
| 5,991,925 | A | * | 11/1999 | Wu | 2/102 |
| 6,216,932 | B1 | * | 4/2001 | Wu | 224/583 |

* cited by examiner

*Primary Examiner*—Stephen K. Cronin
(74) *Attorney, Agent, or Firm*—Patton Boggs LLP

(57) ABSTRACT

The present invention is that of an improved device for carrying a weapon. The present invention provides concealed carrying of a weapon, preferably a handgun, by a law enforcement officer or the like. The handgun is supported on the upper back of the wearer, preferably between the wearer's shoulder blades. The handgun is held in a holster having a body that is formed to match the contour of the gun. The holster includes a sheath of flexible material extending across the upper back of the wearer. The sheath is held in place by a pair of shoulder straps and a pair of armpit straps.

21 Claims, 3 Drawing Sheets

GUN HOLSTER

BACKGROUND OF THE INVENTION

1. Field of the Invention

This invention relates to gun holsters. In particular, the present invention relates to holsters for handguns that may be worn on the body without impeding the activities of the wearer and in a location where the gun is always quickly and easily accessible to the wearer.

2. Discussion of the Background

Holsters used for carrying hand guns on the body of a person, whether concealed or not, are well-known and should require no extensive description. Generally, a holster may be simply described as a carrying case for a gun. Most commonly, holsters are made of leather or a like material in the form of an enlarged pocket. Holsters are generally, although not necessarily, attached to the waist or shoulder portions of the body of the user by means of a belt or a shoulder strap or harness. Oftentimes a holster is provided with a closure strap or flap that may be secured over the top or opening of the holster pocket and the handgrip portion of the gun carried therein in various ways such as, for example, by means of a snap fastener. Such closure straps or flaps are provided to prevent unintentional dislodgement of the handgun from the holster.

A disadvantage of a holster attached to the waist or shoulder is its usefulness when a law enforcement officer or the like wearing the holster is caught off guard. If such person is forced to put his or her hands on the head, he or she cannot quickly and easily access a concealed gun under the arm or around the waist.

There is a need for a device for securing a handgun that meets all of the exigencies of use that may be encountered in police, security or other law enforcement or military activity while avoiding the encumbrances of conventional holsters.

SUMMARY OF THE INVENTION

It is a primary object of the present invention to provide a novel device for carrying a handgun on a user's back.

Another object of the present invention is to provide a device for carrying a handgun that offers optimum concealability of the handgun while simultaneously offering quick and easy access to the gun.

The above and other objects of the present invention will become more apparent from a reading of the following detailed description of the invention and in conjunction with the figures and the appended claims.

DETAILED DESCRIPTION OF THE INVENTION

The present invention comprises a sheath of flexible material adapted to accommodate a handgun and a harness adapted to fit over the shoulders of the wearer. The sheath generally extends across the upper back of the wearer, roughly between the wearer's shoulder blades, such that the handgun is readily accessible to the wearer upon reaching back over his or her shoulder to quickly and easily withdraw the gun from the holster. In a preferred embodiment of the present invention, the harness comprises a first pair of straps, each extending over opposite shoulders from the top of the sheath, and a second pair of straps, each of which extends under opposite arms of the wearer from the bottom of the sheath.

Figure 1:
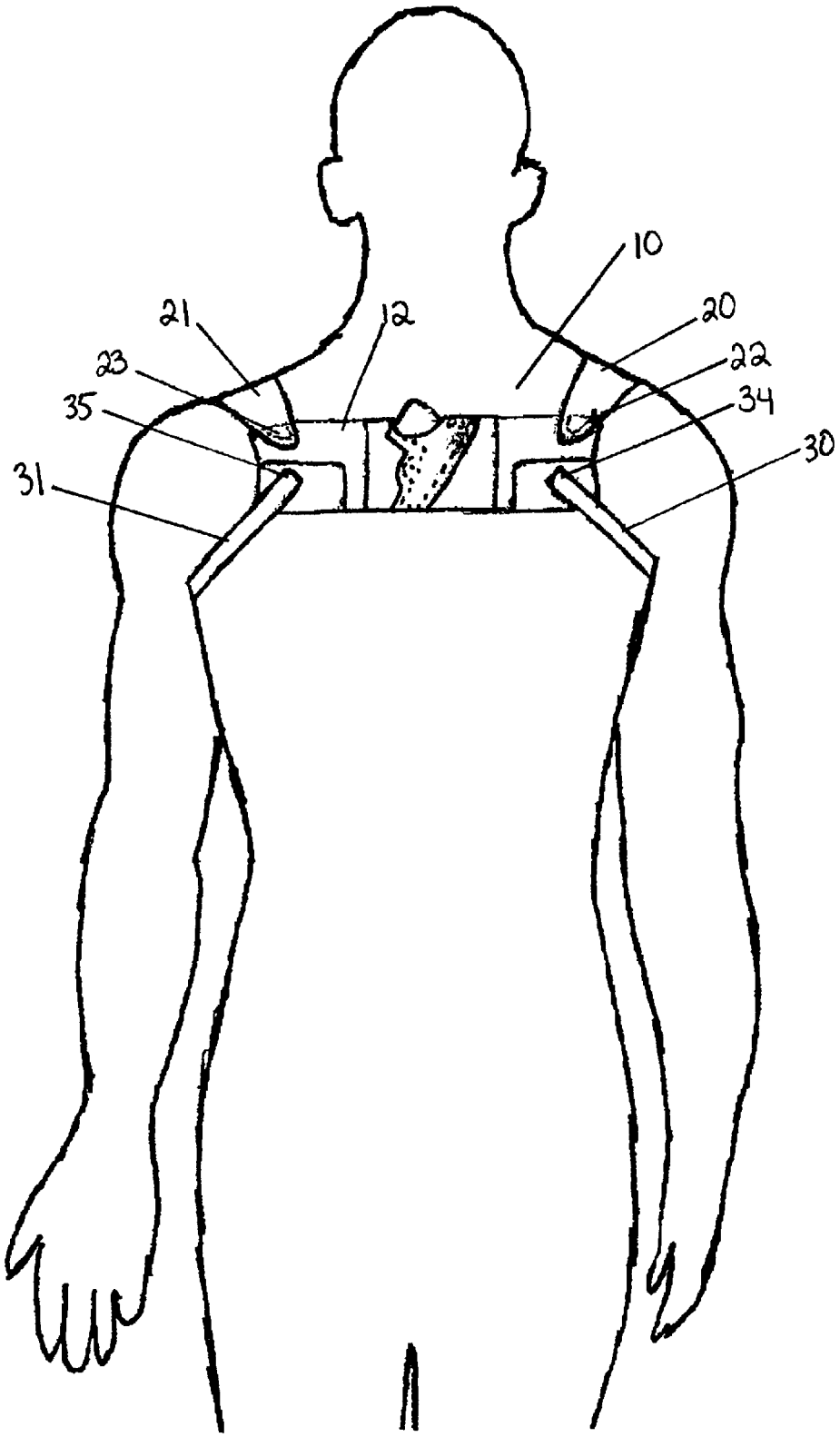
FIG. 1 is a rear view of a holster in accordance with the present invention as worn.

The present invention is best illustrated in FIG. 1, which shows a person wearing the gun holster of the present invention. The gun holster of the present invention depicted therein, and designated generally by reference numeral 10, is viewed from the rear with the jacket of the wearer removed and the arms of the wearer slightly extended to show how the harness 11 of the present invention contours to the body of the wearer and attaches to a sheath 12 of flexible material that supports a retaining cavity 13 and holds the holster close to the body of the wearer.

The holster of the present invention is adapted to position a handgun at the upper back and, preferably, between the shoulder blades, of the wearer. The holster shown is that worn by a right-handed person. For a left-handed person, the stitching (indicated by dotted lines in FIGS. 1–3) for securing the handgun in place would be reversed.

Sheath 12 is positioned across the upper back of the wearer and is supported by straps that will be described in more detail later. As seen in FIG. 1, sheath 12 extends horizontally across the upper portion of the wearer's back, preferably from shoulder blade to shoulder blade. Sheath 12 is made of any suitable flexible material, preferably elastic or an elastic-like material, so that it remains close to the body of the wearer. Sheath 12 is preferably about four to five inches wide and is roughly rectangular in shape. Sheath 12 joins the straps in the vicinity of the shoulder blades of the wearer.

Holster 10 includes a retaining cavity 13 in which a portion of a gun, when holstered, rests. Retaining cavity 13 is formed by sheath 12 and a layer of flexible material 14 overlaying and affixed to sheath 12, preferably in the center of sheath 12 and, therefore, in the center of the wearer's back between the wearer's shoulder blades. The layer of flexible material may be elastic or an elastic-like material. Retaining cavity 13 is positioned on and supported by sheath 12. An opening 15 is provided between sheath 12 and the layer of elastic material 14 for easy receipt and removal of the handgun held therein. Preferably, opening 15 is cut away for easier access to the handgun.

Holster 10 is of conventional construction and is made of any suitable flexible material. Preferably, the holster is also made of elastic or an elastic-like material. More preferably, sheath 12, retaining cavity 13 and layer 14 are made from the same material. Retaining cavity 13 is shaped and sized to the particular handgun being carried. Stitching may be used to secure the handgun therein in place. As previously noted, the holster of the present invention is shown as worn by a right-handed person. For a left-handed person, the placement of the gun in the holster and, therefore, the stitching for securing the handgun, would be reversed. If desired, a holder 16, also made from any suitable elastic or elastic-like material, for an extra magazine 17 may also be attached to sheath 12, also preferably by stitching. This is clearly illustrated in FIGS. 1 and 3.

The holster of the present invention is preferably designed so that the handgun held within is positioned at an angle to the vertical, generally about 20 to 30 degrees. This positioning facilitates grasping and removing of the gun by its handle.

As previously noted, harness 11 supports sheath 12. Harness 11 comprises a first pair of straps, namely right shoulder strap 20 and left shoulder strap 21, and a second pair of straps, namely right armpit strap 30 and left armpit strap 31.

Shoulder straps 20, 21 are adapted to lie on the respective shoulders of the wearer. Shoulder straps 20, 21 generally extend from a region in the vicinity of and slightly above the breast of the wearer, over the tops of the wearer's shoulders and to the region of the shoulder blade of the wearer where shoulder straps 20, 21 attach to sheath 12. The posterior ends 22, 23 of shoulder straps 20, 21 are attached to the upper edge of sheath 12. Preferably, shoulder straps 20, 21 are fixedly attached to sheath 12 such as by stitching. Shoulder straps 20, 21 are preferably made from leather or other strong flexible material.

Figure 2:
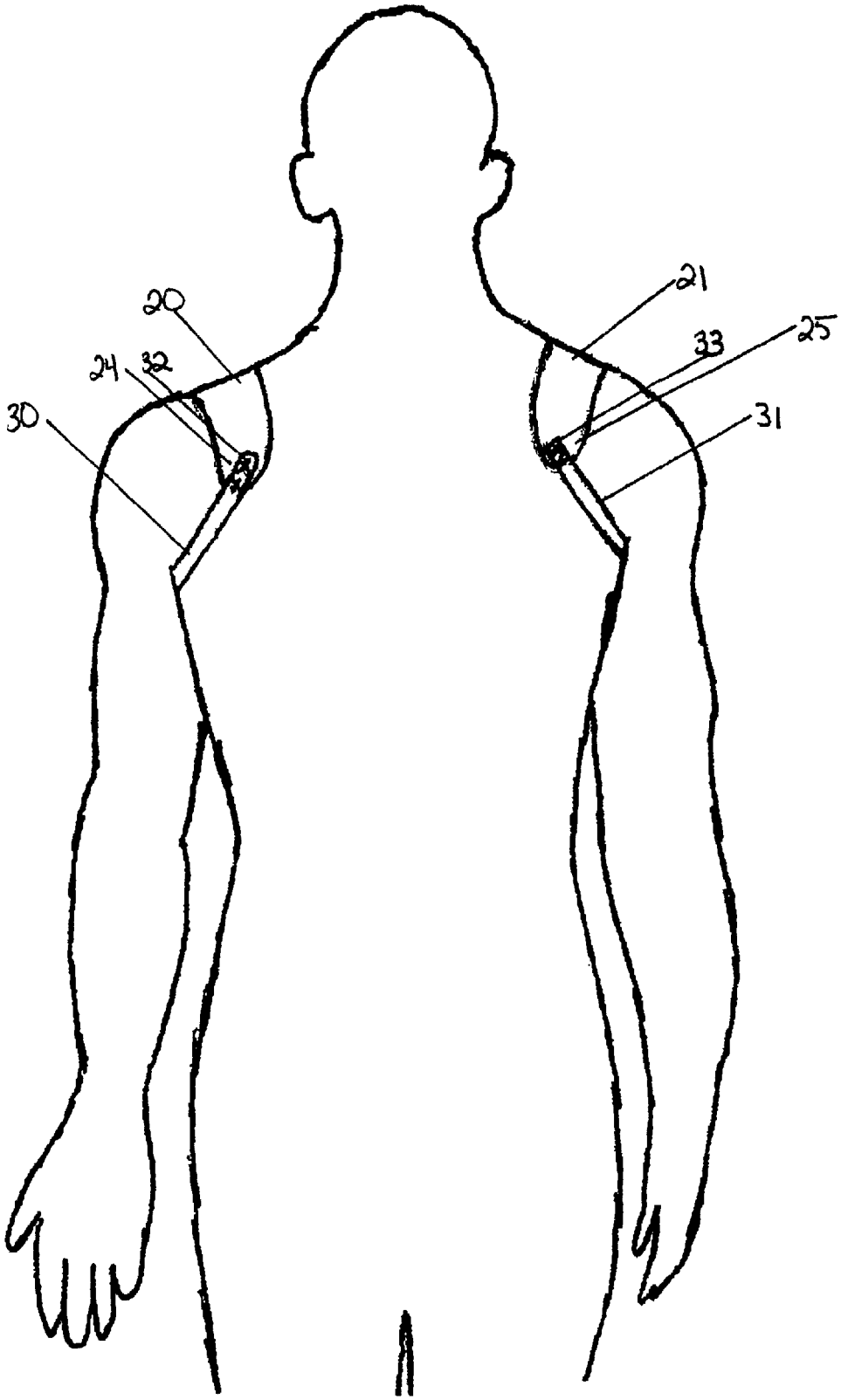
FIG. 2 is a front view thereof.
Figure 3:
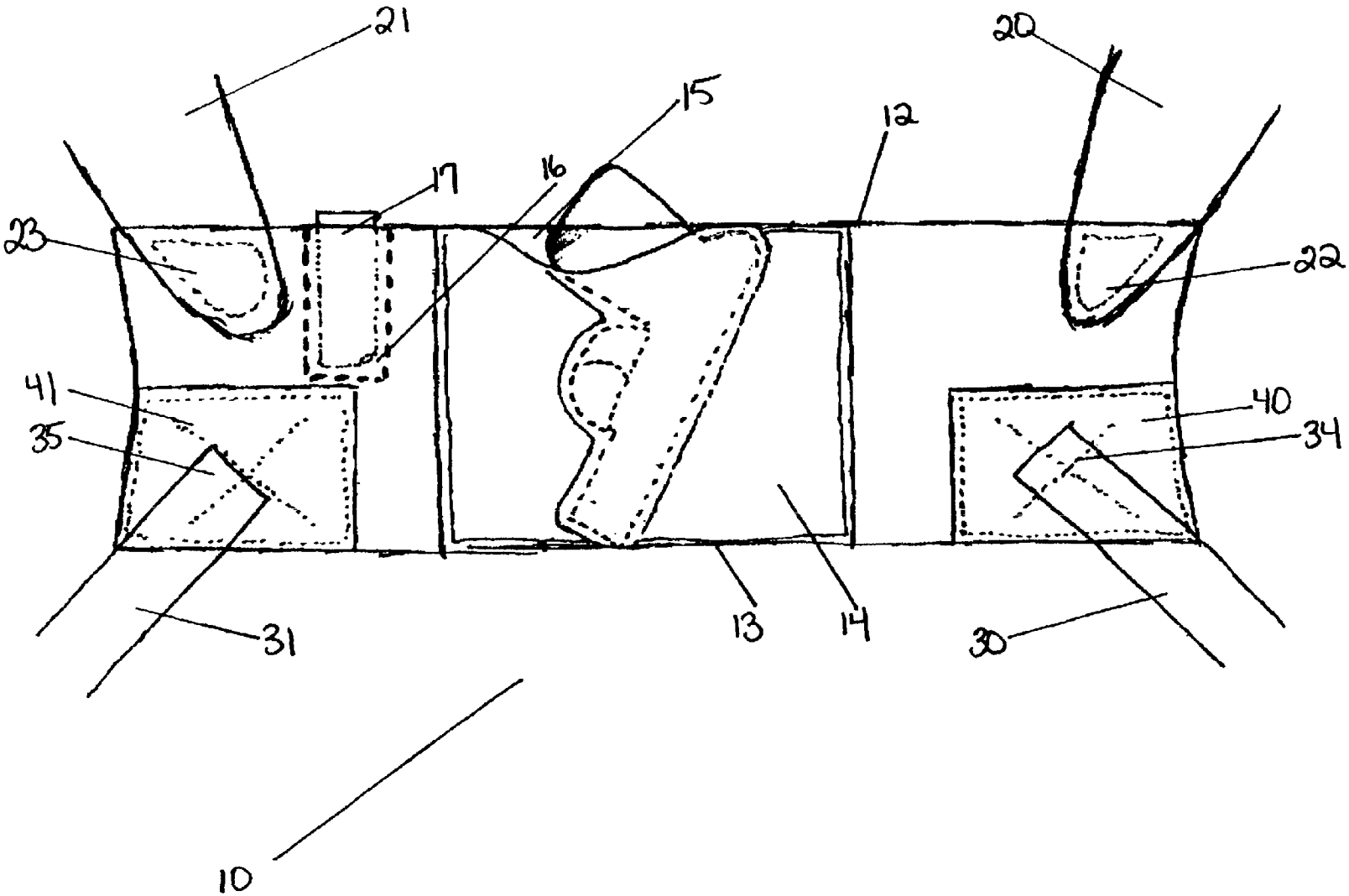
FIG. 3 is a fragmentary view of the front of the holster.

FIG. 2 illustrates the present invention as viewed from the front of the wearer with the wearer's jacket again removed. As shown therein, shoulder straps 20, 21 have their anterior ends 24, 25 attached to the respective anterior ends 32, 33 of armpit straps 30, 31 at a region in the vicinity of and slightly above the breast of the wearer. Shoulder straps 20, 21 are preferably fixedly attached to armpit straps 30, 31 such as by stitching. Armpit straps 30, 31 extend beneath the armpits of the wearer at the respective shoulder strap shoulder. Armpit straps 30, 31 are preferably elasticized for comfort and easy adjustment. Armpit straps 30, 31 are, therefore, preferably made from a flexible material such as elastic or other similar material.

The posterior ends 34, 35 of armpit straps 30, 31 are attached to the lower edge of sheath 12. Preferably, armpit straps 30, 31 are releasably attached to sheath 12 such that the lengths of armpit straps 30, 31 may be adjusted. In such an embodiment, armpit straps 30, 31 include adjustment means for adjusting their lengths. For example, armpit straps 30,31 may be attached to sheath 12 by cooperating hook and loop material such as VELCRO® for the desired easy adjustment. In such an embodiment, posterior ends 34, 35 of armpit straps 30, 31 each have a strip of releasably securable fastener material (not shown) for mating securement with corresponding strips of releasably securable fastener material 40, 41 on sheath 12. In the alternative, armpit straps 30, 31 may be attached to sheath 12 by stitching. In this embodiment, armpit straps 30, 31 are not adjustable and, therefore, various sizes of the holster and harness assembly of the present invention may be manufactured.

With straps adjusted to fit the chest and shoulder regions of the wearer, holster 13 is held snugly against the upper back of the wearer and positioned with no tendency to flop around when the wearer moves. The present invention, being constructed of leather and elastic, or other flexible material, allows the wearer to walk, run or twist his or her shoulders in extreme movements without dislodging gun or assembly itself.

Additionally, the present invention is designed to avoid any bulge visibility through the wearer's jacket at the shoulder line and across the upper back, thereby facilitating concealment of the handgun.

The positioning of the present invention on the upper back of the wearer provides ready access to wearer on reaching back over his or her shoulders.

Having now fully described the invention, it will be apparent to one of ordinary skill in the art that changes and modifications can be made thereto without departing from the spirit or scope of the invention as set forth herein. Unless such changes and modifications depart from the scope of the invention, they should be construed as being included therein. It is intended, therefore, that the foregoing detailed description be understood from the following claims, including all equivalents, which are intended to define the scope of the invention.

What is claimed is:

1. A holster for carrying a handgun on an upper back of a wearer, comprising a sheath, a retaining cavity and a harness, wherein the sheath is adapted to fit on the back of the wearer such that the sheath extends across a portion of the upper back of the wearer, and wherein the retaining cavity includes an opening wider than the barrel portion of the handgun to be carried and having a shape conforming to the silhouette of the handgun, wherein the silhouette includes a trigger guard portion.

2. The holster of claim 1, wherein the sheath is substantially rectangular in shape.

3. The holster of claim 1, wherein the sheath has a width of about 4 to 5 inches to produce broad area contact with the upper back of the wearer.

4. The holster of claim 1, further comprising a holder for an extra magazine.

5. The holster of claim 1, wherein the retaining cavity is defined between the sheath and an overlay material overlaying the sheath, the holster further comprising an opening between the sheath and the overlay material to facilitate receipt and removal of a handgun.

6. The holster of claim 1, wherein the retaining cavity is configured and dimensioned to hold a first portion of a handgun within the cavity and a second portion of the handgun extending beyond the cavity.

7. The holster of claim 1, wherein the sheath and retaining cavity are configured and dimensioned to conceal the handgun when worn beneath clothing.

8. The holster of claim 1, wherein the retaining cavity is configured and dimensioned to hold a handgun snugly therein.

9. The holster of claim 1, wherein the retaining cavity is configured to hold a handgun at an angle to the vertical of about 20–30 degrees.

10. The holster of claim 1, wherein the sheath is made of a flexible material.

11. The holster of claim 10, wherein the flexible material is elastic or an elastic-like material.

12. The holster of claim 1, further comprising a holder.

13. The holster of claim 12, wherein the holder is sized and configured to hold an extra magazine.

14. The holster of claim 1, wherein the harness is adapted to fit over the shoulders of the wearer.

15. The holster of claim 14, wherein the harness comprises a first pair of straps and a second pair of straps.

16. The holster of claim 15, wherein the first pair of straps extends over opposite shoulders of the wearer from an upper edge of the sheath and wherein the second pair of straps extends under opposite arms of the wearer from a lower edge of the sheath.

17. The holster of claim 16, wherein the first and second pairs of straps are fixedly attached at the front of the body of the wearer.

18. The holster of claim 16, wherein the second pair of straps is fixedly attached to the sheath.

19. The holster of claim 16, wherein the second pair of straps is releasably attached to the sheath.

20. The holster of claim 19, wherein adjustment means are located on each of the second pair of straps for adjusting the lengths of each of the second pair of straps.

21. The holster of claim 20, wherein the adjustment means comprise cooperating hook and loop material.

* * * * *